US007473186B2

(12) United States Patent
Best et al.

(10) Patent No.: US 7,473,186 B2
(45) Date of Patent: Jan. 6, 2009

(54) PUTTER WITH VIBRATION ISOLATION

(75) Inventors: Christopher B. Best, Park City, UT (US); Thomas C. Morris, Carlsbad, CA (US); Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/585,231

(22) Filed: Oct. 24, 2006

(65) Prior Publication Data

US 2007/0042835 A1 Feb. 22, 2007

Related U.S. Application Data

(63) Continuation-in-part of application No. 10/827,279, filed on Apr. 20, 2004, now abandoned.

(51) Int. Cl.
*A63B 53/04* (2006.01)

(52) U.S. Cl. ..... 473/329; 473/332; 473/340; 473/342; 473/349

(58) Field of Classification Search ..... 473/324–350, 473/219–256, 288
See application file for complete search history.

(56) References Cited

U.S. PATENT DOCUMENTS

| | | | | | |
|---|---|---|---|---|---|
| 708,575 | A * | 9/1902 | Mules | 473/329 |
| 819,900 | A * | 5/1906 | Martin | 473/329 |
| 2,820,638 | A | 1/1958 | Morrison | 473/252 |
| 4,390,184 | A | 6/1983 | Rudell | 473/253 |
| 4,792,140 | A * | 12/1988 | Yamaguchi et al. | 473/331 |
| 4,804,188 | A * | 2/1989 | McKee et al. | 473/342 |
| 5,299,807 | A | 4/1994 | Hutin | 473/329 |
| 5,505,453 | A * | 4/1996 | Mack | 473/329 |
| 5,524,331 | A * | 6/1996 | Pond | 29/527.4 |
| 5,944,619 | A | 8/1999 | Cameron | 473/332 |
| 6,083,117 | A | 7/2000 | Hsu | 473/332 |
| 6,095,931 | A * | 8/2000 | Hettinger et al. | 473/341 |
| 6,203,443 | B1 * | 3/2001 | Britton | 473/244 |
| 6,227,986 | B1 * | 5/2001 | Fisher | 473/342 |
| 6,231,458 | B1 | 5/2001 | Cameron et al. | 473/332 |
| 6,270,423 | B1 * | 8/2001 | Webb | 473/226 |
| 6,273,831 | B1 | 8/2001 | Dewanjee | 473/324 |
| 6,302,807 | B1 | 10/2001 | Rohrer | 473/329 |
| 6,305,063 | B1 | 10/2001 | Ashcraft et al. | 29/418 |
| 6,319,149 | B1 | 11/2001 | Lee | 473/342 |
| 6,334,818 | B1 | 1/2002 | Cameron et al. | 473/332 |
| 6,364,789 | B1 | 4/2002 | Kosmatka | 473/329 |
| 6,406,379 | B1 | 6/2002 | Christensen | 473/251 |
| 6,431,997 | B1 | 8/2002 | Rohrer | 473/324 |
| 6,478,690 | B2 | 11/2002 | Helmstetter et al. | 473/324 |
| 6,659,883 | B2 | 12/2003 | Nelson et al. | 473/324 |

(Continued)

FOREIGN PATENT DOCUMENTS

JP 52-144055 11/1977

(Continued)

*Primary Examiner*—Sebastiano Passaniti
(74) *Attorney, Agent, or Firm*—Hanify & King, P.C.

(57) ABSTRACT

A golf club head with a vibration dampening insert is disclosed. The club head includes a face member, a dampening member, and a body member. The dampening member is sandwiched between the face member and the body member and extends along a large percentage of the face member. The dampening layer attenuates vibrations, providing consistent feel across the length of the striking face.

18 Claims, 5 Drawing Sheets

U.S. PATENT DOCUMENTS

| | | | | |
|---|---|---|---|---|
| 6,663,496 | B2 | 12/2003 | Cameron et al. | 473/220 |
| 6,672,975 | B1 * | 1/2004 | Galloway | 473/342 |
| 6,729,972 | B2 * | 5/2004 | Boord | 473/340 |
| 6,951,518 | B2 | 10/2005 | Solheim et al. | 473/324 |

FOREIGN PATENT DOCUMENTS

| | | |
|---|---|---|
| JP | 06-218084 | 8/1994 |
| JP | 09-164230 | 6/1997 |

* cited by examiner

PUTTER WITH VIBRATION ISOLATION

CROSS-REFERENCE TO RELATED APPLICATIONS

This is a continuation-in-part of U.S. patent application Ser. No. 10/827,279 filed on Apr. 20, 2004, now abandoned, which is incorporated herein by reference in its entirety.

BACKGROUND OF THE INVENTION

1. Field of the Invention

The present invention relates to a golf club, and, more particularly, to a golf putter having a vibration dampening member.

2. Description of the Related Art

Golf clubs have long been developed to improve the "touch and feel" of the club, including the clubs used on and around the green. One approach to improve the touch and feel of a club is to modify either the grip, the shaft, or the strike face of the golf club. For example, modifications to the club head could include an insert that is placed on the club strike surface to affect the impact of the club with the golf ball and to improve the feedback to the golfer after impact.

Some known golf clubs include a dampening insert. However, these known dampeners result in an inconsistent feel across the face of the golf club. The feel of the club, and the performance of the golf ball upon being struck, vary depending on what portion of the striking face contacts the golf ball.

Thus, what is needed is a golf club with a vibration dampening insert that provides consistent feel across the length of the striking face.

SUMMARY OF THE INVENTION

The present invention relates to a golf club head having a vibration dampening member. The club head includes a face member, a dampening member, and a body member. The face member has a striking face and a rear surface opposite the striking face. The dampening member is connected to the rear surface of the face member. The body member is connected to the dampening member opposite the face member. The body member includes a hosel for attaching a shaft to the club head. Preferably, the face member is formed of aluminum or an aluminum alloy and the body member is formed of steel.

The dampening member extends along a large percentage of the face member. This helps ensure that vibrations generated during normal use of the club are attenuated regardless of what part of the club face strikes the ball, and also provides a softer feel to the club. Preferably, the dampening member is connected to substantially all of the face member rear surface, which substantially isolates the face member from the body member. To further ensure any vibrations are attenuated and to further enhance the feel of the club, the face member is completely isolated from the body member by the dampening member. Preferably, the rear surface of the face member has a perimeter profile, and the dampening member has a perimeter profile that is substantially the same as the rear surface perimeter profile. An adhesive can be used to connect the parts, and the dampening member itself may service as an adhesive. Mechanical fasteners, either alone or in conjunction with an adhesive, can also be used.

The dampening member may preferably include one or more of rubber, urethane, polyurethane, butadiene, polybutadiene, and silicone. The dampening member may be a composite layer. Furthermore, the dampening member can be provided in a color contrasting the colors of the face member and the body member. This color difference can be a useful tool for the golfer to use when aligning the shot. The dampening member is preferably approximately 0.02 inch to approximately 1 inch thick, and more preferably approximately 0.03 inch to approximately 0.08 inch thick. The face member is preferably approximately 0.05 inch to approximately 0.25 inch thick, and more preferably approximately 0.1 inch to approximately 0.2 inch.

The club head of the present invention can be assembled using a mold containing two mold plates. The face member is placed in a cavity within one plate of the mold and the body member is placed in a cavity of a corresponding plate of the mold. The body member is placed within one of the mold cavities. An adhesive may optionally be placed between the club head parts. The mold plates are then compressed together under force, compressing the dampening member 20 to desired thickness and dimensions. The surfaces of the parts may be roughened to facilitate bonding, and the mold may optionally be heated during the molding process.

According to another aspect of the invention, the body member defines a cavity into which the face member and damping member are positioned. Fasteners, such as mechanical fasteners, attach the club head components. By varying the tension imparted by the fasteners, the damping ability of the damping member can be altered and tailored to a specific golfer's individual desire.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
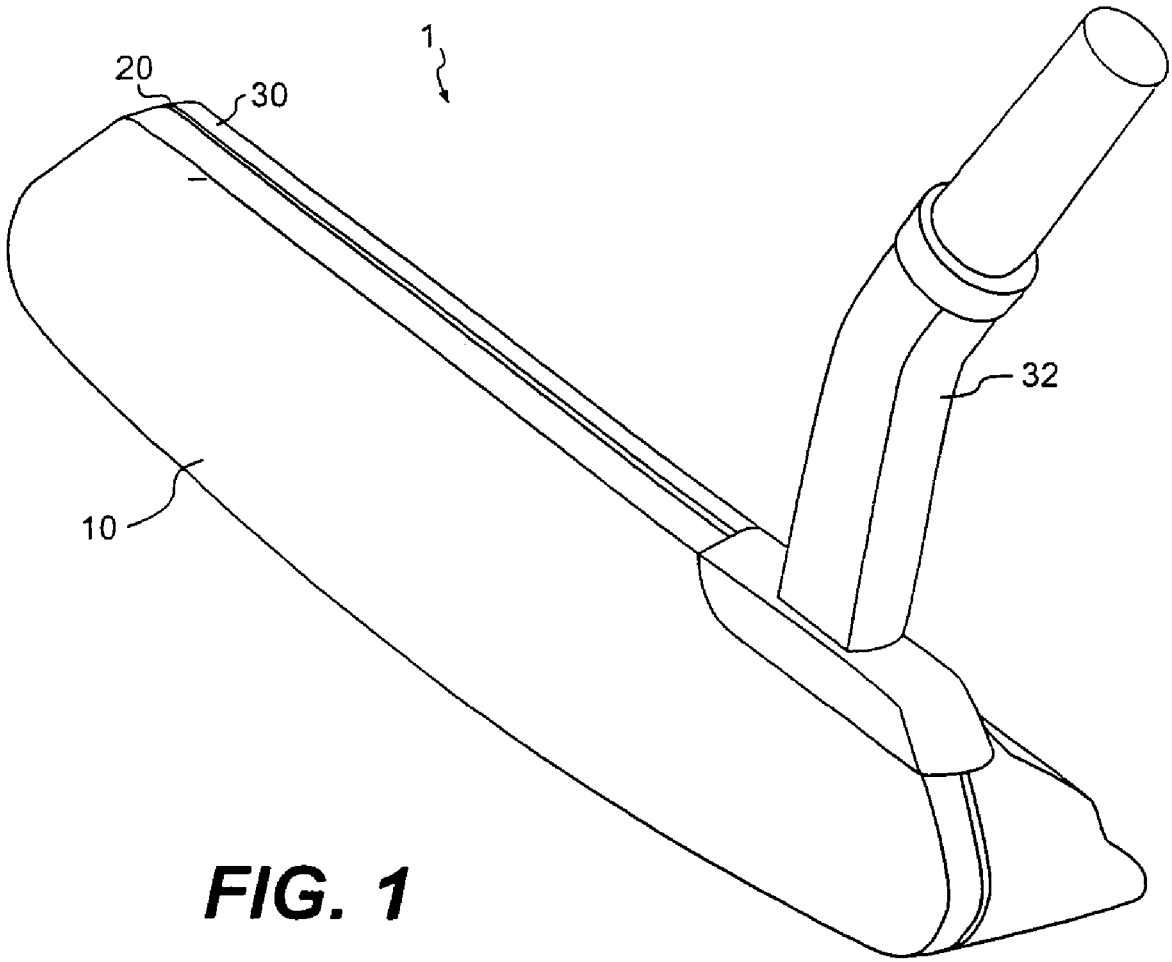
FIG. 1 shows a golf club head of the present invention.

FIG. 1 shows a golf club head 1 of the present invention. The club head, which is shown as a putter head in the illustrated embodiment, includes a face member 10, a dampening member 20 illustrated as a layer of dampening material, and a body member 30. The face member 10 has a striking face 12 and a rear surface 14 opposite the striking face 12. The dampening member 20 is coupled to the rear surface 14. The body member 30 is coupled to the dampening member 20 on a surface opposite the face member 10, and includes a hosel 32 for connecting the club head 1 to a shaft.

Figure 2:
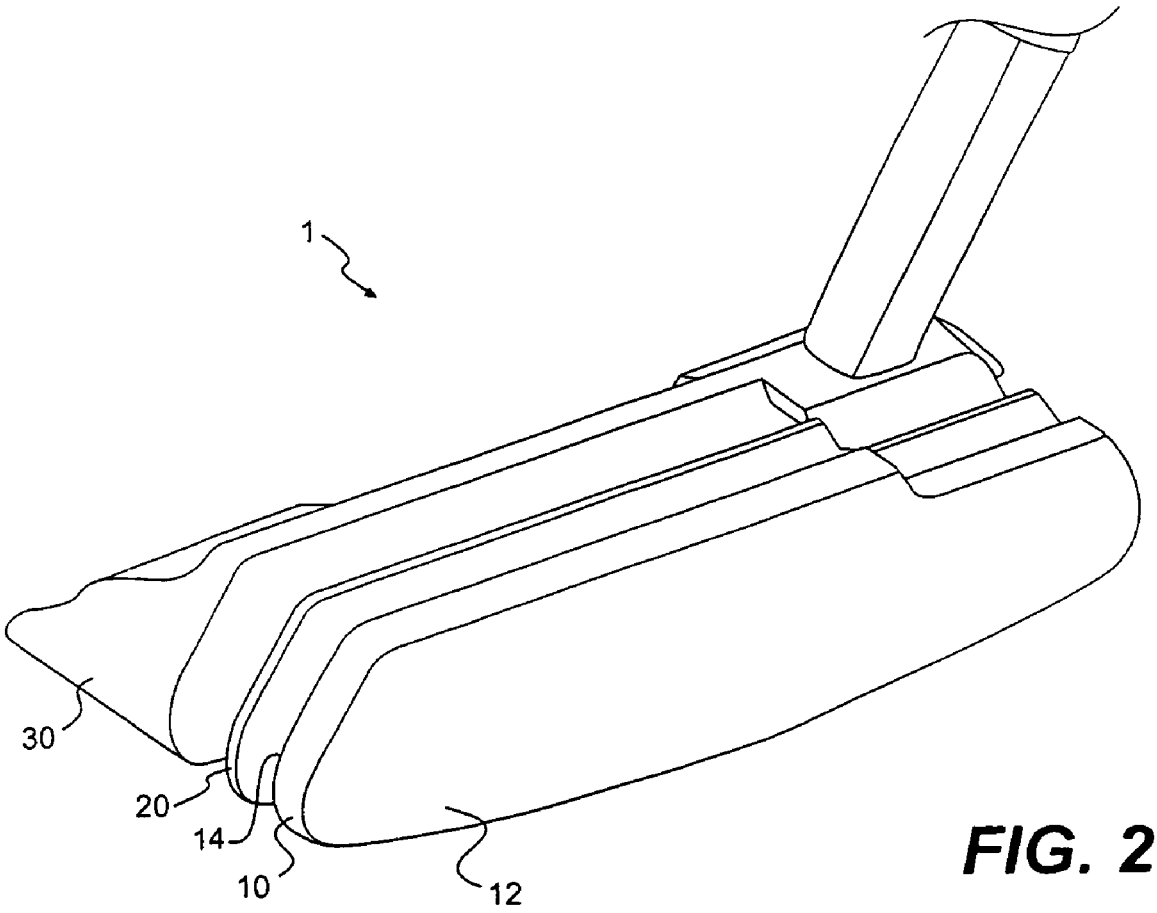
FIG. 2 shows an exploded view of the golf club head of FIG. 1.

FIG. 2 shows an exploded view of the golf club head 1. The dampening member extends along a large percentage of the face member 10. This helps ensure that vibrations generated during normal use of the club are attenuated regardless of what part of the club face strikes the ball. This also provides a softer feel to the face member 10. Preferably, the dampening member 20 is coupled to substantially all of the rear surface 14, substantially isolating the face member 10 from the body member 30. There may be some portion of the face member 10, such as at the hosel 32, that contacts the body member 30. This may allow some vibrations to be transmitted around the dampening member 20. Some amount of the vibrations may also be transmitted through any mechanical fasteners that couple the face member 10, dampening member 20, and body member 30.

The surfaces around the hosel 32 can be dealt with in a variety of manners. One option, as mentioned above, is to simply allow the face member 10 and the body member 30 to be in contact. Another option is to leave a gap between the face member 10 and the body member 30 around the hosel 32. A third option is to provide a dampening material between the face member 10 and the body member 30. This dampening material may be the same as the dampening member 20 or it may be independent from the dampening member 20.

Figure 3:
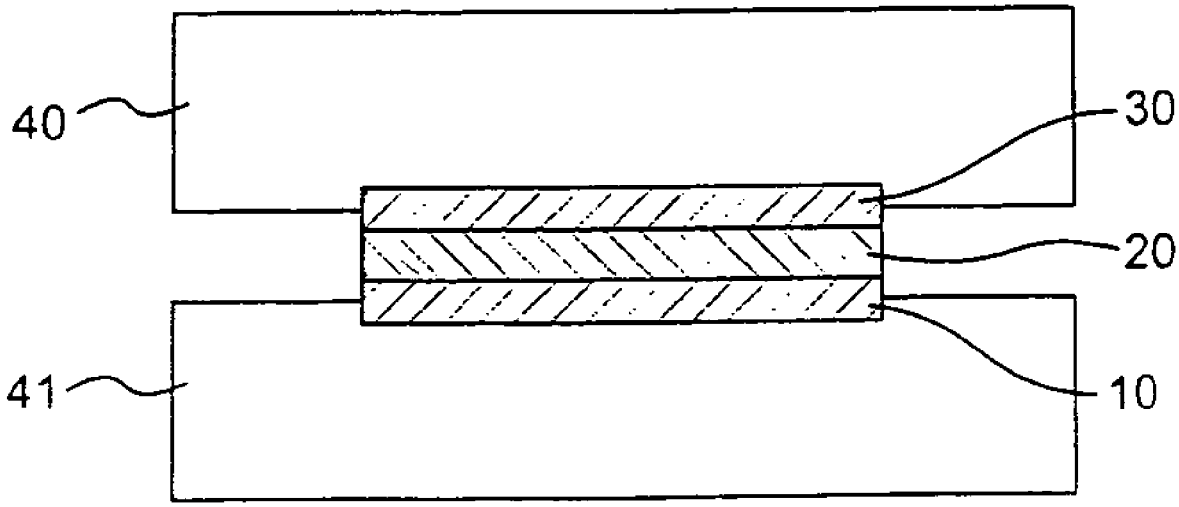
FIG. 3 shows a cross-section of a preferred assembly setup for the golf club head of FIG. 1.

To further ensure any vibrations are attenuated and to further enhance the feel of the club, the face member 10 is completely isolated from the body member 30 by the dampening member 20. Preferably, the rear surface 14 has a perimeter profile, and the dampening member 20 has a perimeter profile that is substantially the same as the rear surface perimeter profile. An adhesive can be used to couple the parts together. FIG. 3 shows a cross-section of a preferred assembly setup for the golf club head 1. An upper mold part 40 and a lower mold part 41 are provided, and the face member 10, dampening member 20, and body member 30 are positioned in mold cavities. Adhesive may be placed between the club parts. The mold plates 40, 41 are compressed together under force, compressing the dampening member 20 to desired thickness and dimensions. The surfaces of the parts may be roughened to facilitate bonding. Since the dampening material 20 is much softer than either the face member 10 or the body member 30, it takes on effectively all of the compressive force. The mold may optionally be heated during the molding process. The dampening material may preferably be chosen such that no additional adhesive is required. Any excess material is trimmed off after removing the club head 1 from the mold.

Preferred dampening materials include one or more of rubber, urethane, polyurethane, butadiene, polybutadiene, and silicone. The dampening member 20 may be a composite layer. For example, different materials can be provided in the toe, center, and heel portions of the dampening member 20. Furthermore, the dampening member 20 can be provided in a color contrasting the colors of the face member 10 and the body member 30. This color difference can be a useful tool for the golfer to use when aligning the shot. The dampening member 20 is preferably approximately 0.02 inch to approximately 1 inch thick, and more preferably approximately 0.03 inch to approximately 0.08 inch thick, where thickness is measured in a direction substantially perpendicular to the longitudinal axis of the club head 1.

Aluminum is a preferred material for the face member 10. Aluminum is relatively soft, enhancing the feel of the club head 1. Steel is a preferred material for the body member 30. The face member 10 is preferably approximately 0.05 inch to approximately 0.25 inch thick, and more preferably approximately 0.1 inch to approximately 0.2 inch thick.

Steel is relatively heavy, providing a solid feel to the club head 1. The body member 30 can designed to increase the club head moment of inertia about a vertical axis passing through the club head center of gravity. This could be done, for example, by placing weights in the heel and toe portions of the body member 30.

Figure 4:
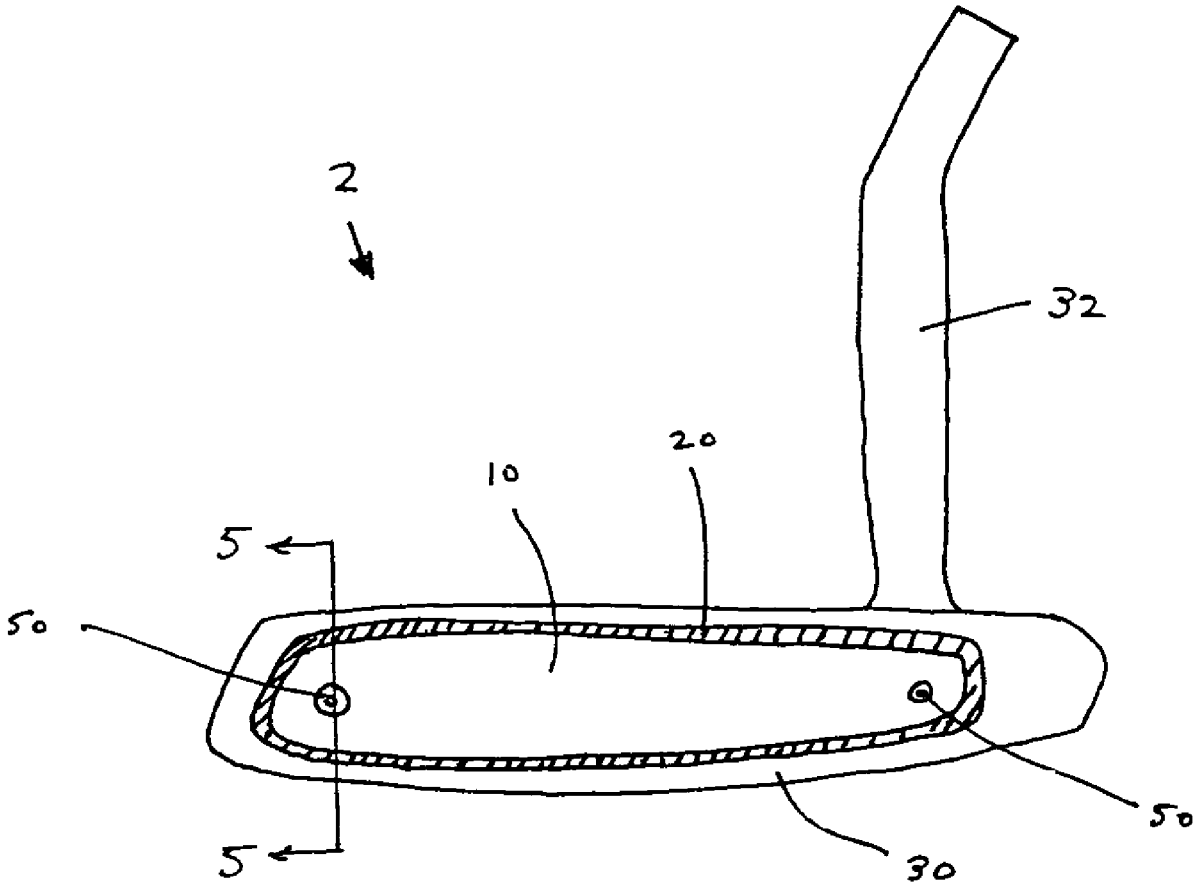
FIG. 4 shows a front view of a golf club head of the present invention.
Figure 5:
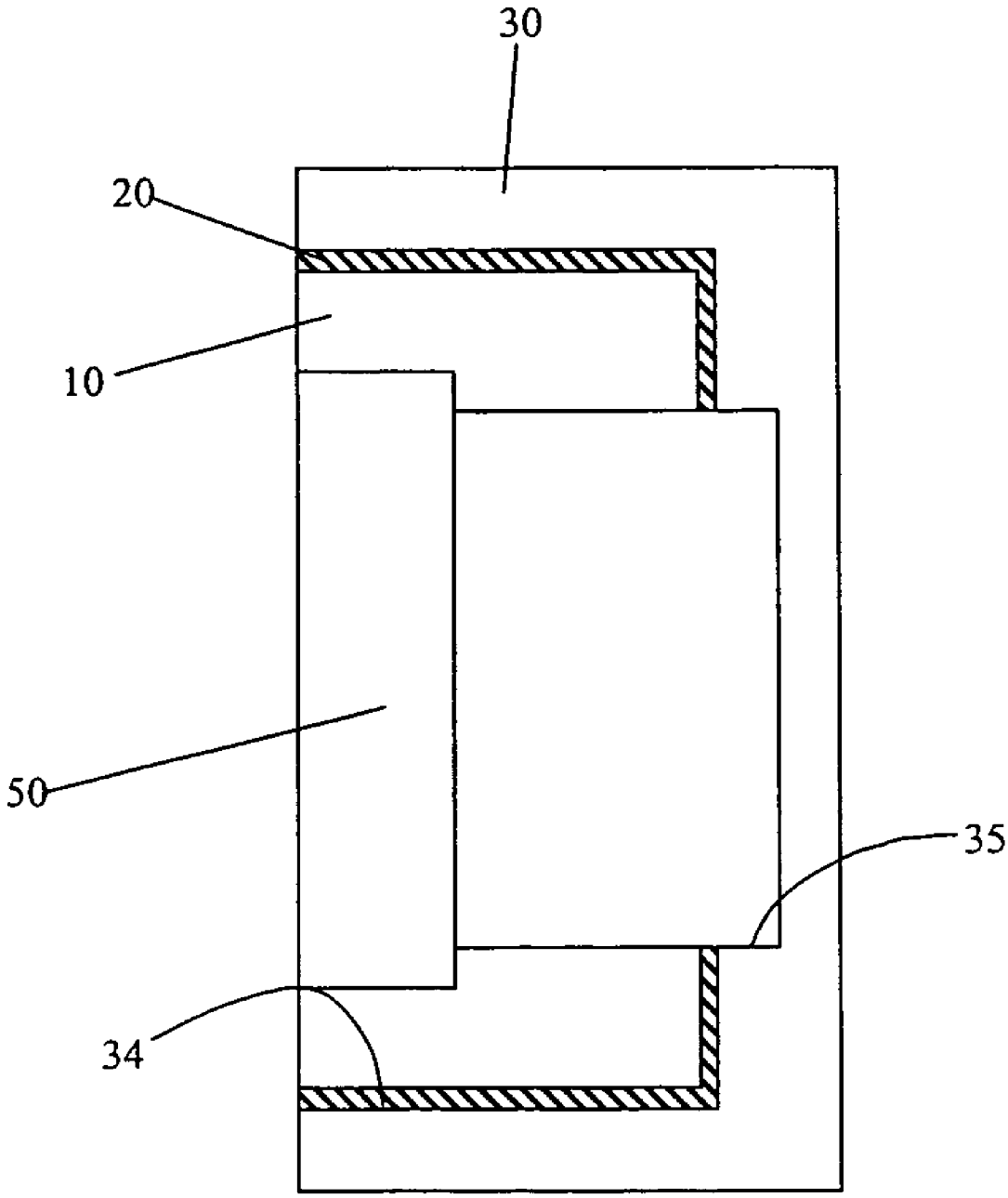
FIG. 5 shows a cross-sectional view through line 5-5 in FIG. 4.

FIG. 4 shows a front view of a golf club head 2 of the present invention. The club head 2 is similar to the previously discussed club head 1, but has a different construction. This club head 2 also includes a face member 10, a damping member 20, and a body member 30. The arrangement of these elements, however, is different. This club head 2 also includes fasteners 50. While two such fasteners 50 are shown in the illustrated embodiment of FIG. 4, one in the heel and one in the toe, additional fasteners 50 may be used. For example, while the fasteners 50 are shown as being positioned substantially at a vertical midpoint of the club head 2, additional fasteners 50 may be included such that there are two fasteners in each of the heel and toe of the club head 2, one positioned towards the top line of the club head 2 and the other positioned towards the sole of the club head 2. Additional configurations may also be used. Furthermore, alternative positioning of the fasteners 50 along the longitudinal axis of the club head 2 may be used. The fasteners 50 may take a variety of forms, such as a screw or a bolt. Preferably, the fasteners 50 are designed such that they are not readily adjustable. For example, the fasteners 50 may have an engagement surface that is operable only with specialized or pneumatic tooling rather than a typical screw driver or wrench. FIG. 5 shows a cross-sectional view through line 5-5 in FIG. 4, which passes through one of the fasteners 50. It should be noted that while not shown in FIGS. 4 or 5, the club head 2 may include flanges or otherwise have a weight positioning body shape to provide the desired moment of inertia, center of gravity location, and other design and performance characteristics.

As seen most clearly in FIG. 5, the body member 30 defines a cavity 34 in a front or face area or region thereof. The face member 10 is positioned within the cavity 34, with the damping member 20 being intermediate the face member 10 and the body member 30. The damping member 20 substantially envelops the face member 10, substantially isolating it from the body member 30. This maximizes the damping ability of the damping member 20. The face member 10, the damping member 20, and the body member 30 form a flush putting surface of the golf club head 2. In one preferred embodiment, the fasteners 50 connect the face member 10, the damping member 20, and the body member 30 through toe and heel portions thereof. This may be accomplished, for example, by providing holes through the face member 10 and the damping member 20, the holes being relatively aligned and also aligned with a threaded recess 35 provided in the body member 30. In this manner, a threaded end of the fasteners 50 can pass through the face member 10 and the damping member 20, and be mechanically engaged with and retained by the threads of the body member threaded recess 35.

As each fastener 50 is driven further into the body member 30, more force is applied through the face member 10 to the compressible damping member 20. That is, the level of tension imparted by the fasteners 50 to the face member 10, the damping member 20, and the body member 30 is increased. The more the damping member 20 is compressed, the more its ability to absorb and damp vibration and other stresses is reduced. Thus, the damping ability of the damping member 20 may be adjusted and customized by adjusting the level of engagement of the fasteners 50 to the club head body 30. For example, if a golfer prefers a "soft" feeling club, the fasteners 50 can be engaged a relatively lesser amount with the body member 30, leaving the damping member 20 in a relatively uncompressed state and therefore able to damp a relatively greater amount of vibration. Alternatively, if a golfer prefers a "solid" feeling club, the fasteners 50 can be engaged a relatively greater amount with the body member 30, compressing the damping member 20 and therefore reducing its ability to damp vibration. In this manner, the club head 2 can be tailored to suit virtually any golfer's desired feel. Furthermore, the individual fasteners 50 are relatively independent and they therefore can be engaged with the body member 30 to different degrees, providing a varying feel to the club head across the longitudinal axis (heel-to-toe) of the club head 2.

Of course, the individual fasteners 50 can be engaged so as to provide a constant feel across the face of the club head 2.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the invention has been described above in terms of a golf putter, the disclosed ideas and concepts could also be applied to other types of golf clubs, including iron-type clubs, wood-type clubs, and hybrid clubs. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a body member defining a cavity in a face area thereof;

a face member positioned within said cavity;

a dampening member intermediate said body member and said face member, wherein said dampening member substantially envelops said face member, substantially isolating said face member from said body member;

a first fastener connecting said body member, said face member, and said dampening member through toe portions thereof;

and a second fastener connecting said body member, said face member, and said dampening member through heel portions thereof;

wherein said first and second fasteners are adjustable so as to impart variable levels of tension to said body member, said face member, and said dampening member.

2. The golf club head of claim 1, wherein said body member, said face member, and said dampening member are positioned to form a flush putting surface of the golf club head.

3. The golf club head of claim 1, wherein said body member includes a hosel for attaching a shaft to the club head.

4. The golf club head of claim 1, wherein:

said face member defines a first hole and a second hole therethrough;

said dampening member defines a first hole and a second hole therethrough;

said body member defines a first and a second threaded recess therein;

said first face member hole, said first dampening member hole, and said first body member threaded recess are substantially aligned;

and said second face member hole, said second dampening member hole, and said second body member threaded recess are substantially aligned.

5. The golf club head of claim 4, wherein:

said first fastener passes through said first face member hole and said first dampening member hole, and is mechanically retained by said threads within said first body member threaded recess; and said second fastener passes through said second face member hole and said second dampening member hole, and is mechanically retained by said threads within said second body member threaded recess.

6. The golf club head of claim 1, wherein said dampening member has a thickness from approximately 0.02 inch to approximately 1 inch.

7. The golf club head of claim 6, wherein said thickness is from approximately 0.03 inch to approximately 0.08 inch.

8. The golf club head of claim 1, wherein the face member has a thickness from approximately 0.05 inch to approximately 0.25 inch.

9. The golf club head of claim 8, wherein said thickness is from approximately 0.1 inch to approximately 0.2 inch.

10. The golf club head of claim 1, wherein said first and second fasteners are independently adjustable so as to independently impart variable levels of tension to said body member, said face member, and said dampening member.

11. The golf club head of claim 1, wherein said first and second fasteners are adjustable so as to vary the dampening ability of said dampening member.

12. The golf club head of claim 1, wherein the golf club head is a putter head.

13. A golf club head, comprising:

a body member defining a cavity in a face area thereof;

a face member positioned within the cavity;

a dampening member disposed between the body member and the face member, wherein the dampening member substantially envelops the face member;

a first fastener connecting the body member, the face member, and the dampening member through toe portions thereof;

and a second fastener connecting the body member, the face member, and the dampening member through heel portions thereof;

wherein the first and second fasteners are adjustable so as to impart variable levels of tension to the body member, the face member, and the dampening member.

14. The golf club head of claim 13, wherein the first and second fasteners are adjustable so as to vary the dampening ability of the dampening member.

15. The golf club head of claim 13, wherein the first and second fasteners are independently adjustable so as to independently impart variable levels of tension to the body member, the face member, and the dampening member.

16. The golf club head of claim 13, wherein the dampening member completely isolates the face member from the body member.

17. The golf club head of claim 13, wherein the dampening member comprises rubber, polyurethane, polybutadiene, silicone, or combinations thereof.

18. The golf club head of claim 13, wherein the dampening member comprises a first material at a toe portion, a second material at a center portion, and a third material at a heel portion.

* * * * *